United States Patent [19]

Compagnon

[11] Patent Number: 4,757,691

[45] Date of Patent: Jul. 19, 1988

[54] COOLING PROCESS AND TUNNEL

[75] Inventor: Jean Compagnon, Boulogne, France

[73] Assignee: Carboxyque Francaise, Paris, France

[21] Appl. No.: 63,461

[22] Filed: Jun. 18, 1987

[30] Foreign Application Priority Data

Jun. 18, 1986 [FR] France ..... 86 08774

[51] Int. Cl.[4] ..... F25D 13/06

[52] U.S. Cl. ..... 62/63; 62/374; 62/380; 62/224

[58] Field of Search ..... 62/63, 374, 375, 380, 62/224

[56] References Cited

U.S. PATENT DOCUMENTS 3,345,828 10/1967 Klee et al. ..... 62/380
3,403,527 10/1968 Berreth et al. ..... 62/380
3,600,901 8/1971 Wagner ..... 62/380
3,892,104 7/1975 Klee et al. ..... 62/380
4,589,264 5/1986 Astrom ..... 62/374

FOREIGN PATENT DOCUMENTS 0024159 2/1981 European Pat. Off. .
0103387 2/1946 Netherlands .
1283073 7/1972 United Kingdom .

*Primary Examiner*—Ronald C. Capossela
*Attorney, Agent, or Firm*—Young & Thompson

[57] ABSTRACT

Liquid carbon dioxide is injected through one end into the upper compartment (14) of the tunnel. The gaseous $CO_2$ is circulated in the lower compartment (13) partly in a countercurrent manner and partly in a cocurrent manner relative to the objects (22) to be cooled, by a central fan (9). Application in the temporary hardening of products of rubber and plastics material and in the precise cooling of food products.

14 Claims, 1 Drawing Sheet

COOLING PROCESS AND TUNNEL

Figure 1:
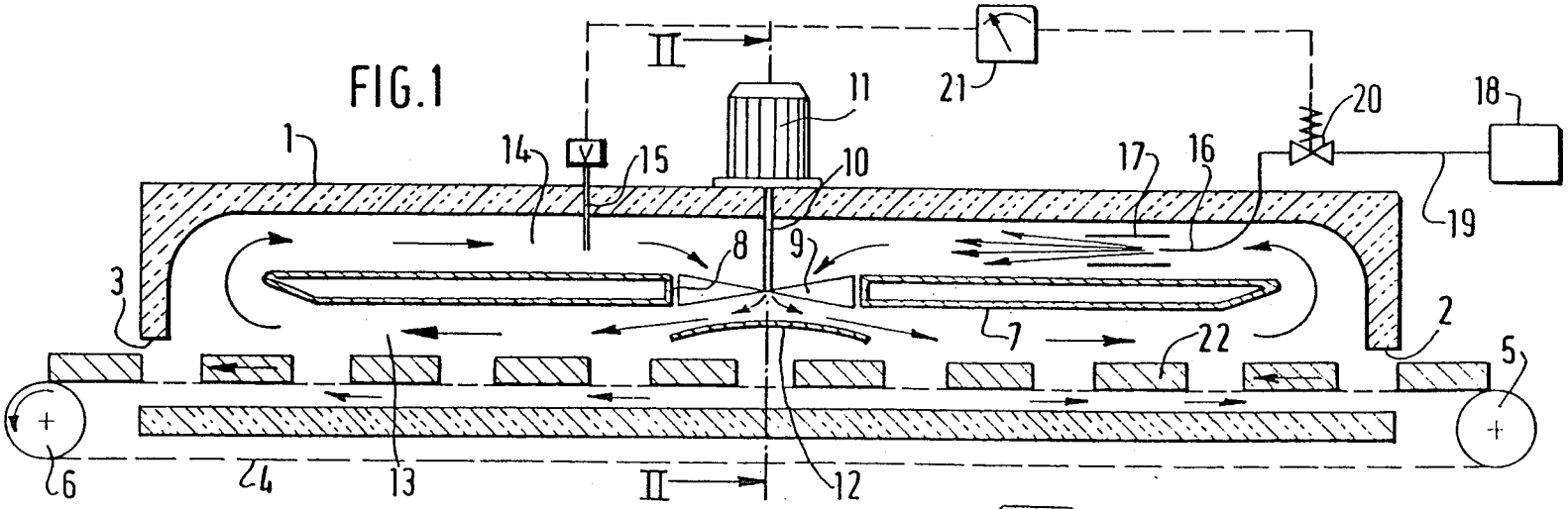

The present invention relates to a process and a tunnel for cooling a product by means of a cryogenic liquid. The term "product" is intended to mean either a object of great length such as a pipe, or a succession of small objects.

The invention is applicable in particular to the following cases:

modification of the mechanical properties of a product, for example hardening of rubber pipes for the laying of an outer metallic braid, hardening of sheets or rings of rubber or plastics material for the obtainment of a clean cut, hardening of extruded products such as confectionery or cheese, etc.;

acceleration of the cooling of products to avoid their storage and permit a continuous fabrication, for example cooling of biscuits issuing from the oven for the continuous packing thereof, subcooling of ice creams before hot coating thereof, rapid setting of jellies in delicatessen, etc.

All these cases have two imperative requirements:

(1) The obtainment of a homogeneous result throughout the production. For example, as concerns biscuit production lines, an excessively hot biscuit will give off water vapour in its package and result in condensation and mildew whereas an excessively cold biscuit will condense the moisture when it reaches the open air and this will result in the same drawback as before.

(2) The possibility of exactly adapting the temperature of the tunnel to the nature of the product and to the desired result. For example, if it concerns the cooling of a product in depth with a minimum temperature gradient, it must be possible to regulate the temperature of the tunnel in a precise manner in accordance with the thermal conductivity of the product, and the gas circulating over the product must be devoid of any liquid particles (liguid nitrogen) or solid particles (carbon dioxide snow) which would produce cold points on the suface resulting in either condensation or a deterioration of the appearance of the product. If it concerns the obtainment of a surface hardening (crusting), it must be possible to regulate the temperature to a minimum value which gives this result without adversely affecting the surface of the product.

An object of the invention is therefore to provide a process and an apparatus for cooling objects which may be discrete or of great length in a rapid and continuous manner and at precise temperatures.

The invention therefore provides a process for cooling a product by injection of a cryogenic liquid into a tunnel through which said product travels longitudinally, comprising dividing the tunnel into two longitudinally-extending compartments which communicate with each other at the two ends of the tunnel and at an intermediate place of the length of the tunnel and in particular substantially midway of said length, conveying the product longitudinally of the tunnel through a first said compartment, injecting the cryogenic liquid into the second said compartment, and creating between the two compartments a forced circulation of the gases resulting from the vaporization of the liquid by blowing said gases from the second compartment into the first compartment at said intermediate place.

According to advantageous features:

the cryogenci liquid is injected from adjacent only one end of the tunnel;

the injection of cryogenic liquid is regulated by measuring the temperature of the gases at a point of the tunnel where this liquid is completely vaporized.

The invention also provides a product-cooling tunnel comprising a partition which divides it into two longitudinally-extending compartments which communicate with each other at both ends of the tunnel and at an intermediate place of the length of the tunnel and in particular substantially midway of said length, means for conveying the product longitudinally of the tunnel through a first said compartment, means for injecting a cryogenic liquid into the second said compartment, and circulation means for passing the gases resulting from the vaporization of the liquid from the second compartment to the first compartment at said intermediate place.

Figure 2:
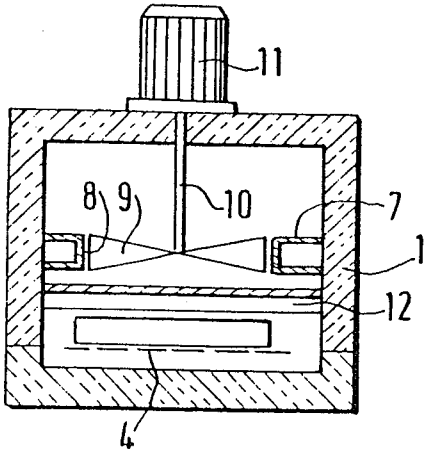

An embodiment of the invention will now be described with reference to the accompanying drawing, in which:

FIG. 1 is a diagrammatic longitudinal sectional view of a cooling tunnel according to the invention, and FIG. 2 is a diagrammatic cross-sectional view taken on line II—II of FIG. 1.

The tunnel represented in FIGS. 1 and 2 comprises a heat insulated outer case 1 of a very elongate generally parallel-sided shape having a horizontal longitudinal axis. This tunnel has in an end wall (on the right of FIG. 1) an entrance window 2 and, in the opposite end wall, an exit window 3. Each window is provided with a flexible curtain (not shown) for reducing as far as possible the entry of air into the tunnel.

A conveyor 4, formed by an apertured endless belt, extends around two return pulleys 5, 6 (of which pulley 6 is a driving pulley) located respectively slightly upstream of the window 2 and slightly downstream of the window 3. The upper reach of this conveyor extends longitudinally through the case 1.

At roughly midway of the height of the space within the case 1 above the conveyor 4, the tunnel is provided with a horizontal partition 7. This partition extends transversely throughout the width of the case and is connected to the lateral walls of the latter. On the other hand, in the longitudinal direction, it terminates short of the two end walls of the case.

The partition 7 is formed by a double sheet so as to have a notable thickness. This partition is tapered at each end: its lower side is upwardly inclined and then rounded for connection to its upper side. At roughly midway of the length of the case, the partition 7 has a circular opening 8 defined by a sleeve. Disposed in this opening is a propeller 9 of a axial-flow fan suspended from a vertical shaft 10 which extends through the ceiling of the case 1. An electric motor 11 for driving the shaft 10 is fixed to this ceiling. A deflector 12, constituted by a longitudinally arch-shaped sheet extending laterally to the lateral walls of the case, is located below the propeller 9.

The partition 7 therefore divides the inner space of the case 1 into two compartments: a first lower compartment 13 through which travels longitudinally the upper reach of the conveyor 4 and which contains the deflector 12, and a second upper compartment 14, these two compartments communicating with each other, on the one hand, at each end of the tunnel, and, on the other hand, through the opening 8.

A temperature probe 15 extends into the upper compartment 14 adjacent to the exit 3 of the tunnel through the ceiling of the case. A capillary tube 16 extends into the same compartment 14 close to the entrance 2 of the tunnel. This capillary tube extends through the ceiling of the case and is then bent so as to lead horizontally into the compartment 14 in the direction toward the shaft 10 of the fan. For the purpose of accelerating the thermal exchange, the capillary tube 16 opens onto the inlet of a venturi 17 which extends longitudinally of the tunnel. Above the case, the upstream end of the capillary tube 16 is connected to a source 18 of liquid carbon dioxide at −20° C. and a pressure of 20 bars through a pipe 19 provided with an electrically-operated valve 20. The latter is controlled in an off/on manner by a temperature regulator-indicator 21 in accordance with data supplied by the temperature probe 15.

In operation, the product to be cooled, formed for example, as shown, by a succession of parallel-sided objects 22, travels through the entire length of the tunnel on the upper reach of the conveyor 4 from the entrance 2 to the exit 3 and passes under the deflector 12. The propeller 9 is driven in rotation and the liquid $CO_2$ is expanded through the capillary tube 16 and forms at the outlet of the latter in the upper compartment 14 carbon dioxide snow which is sublimated. The dimensioning and the regulation are such that the carbon dioxide snow is sublimated before reaching midway in the length of the tunnel and before being deposited on the walls of the latter or on the partition 7. Consequently, in the region of the opening 8, there is no solid particle of $CO_2$, i.e. the propeller 9 causes an exclusively gaseous stream to pass from the compartment 14 to the lower compartment 13.

This gaseous stream is deviated by the deflector 12 toward the two ends of the tunnel and, as any supply of cold passes through the fan, the temperature of the gases sent in both directions in the comparment 13 is very uniform. At each end, the gases travel upwardly into the compartment 14 and are recycled, this motion being favoured by the tapering of the ends of the partition 7. The probe 15 and the regulator 21 regulate the injection of liquid $CO_2$ into the tunnel in such manner as to maintain at a precise value the temperature of the gases flowing in the tunnel, this value being for example regulated between about 0° C. and about −65° C. to within ±1° C.

In this way, the objects 22 undergo first of all a countercurrent cooling up to the deflector 12 and then a cocurrent cooling. This has the advantage of ensuring a uniform cooling of the fornt and rear parts of the objects 22, particularly when the latter are relatively high. Further, a part of the cold gases passes through the conveyor 4 and this also cools the underside of these objects. It may also be mentioned that, owing to the great thickness of the partition 7, the section of the passage for the cold gases is reduced and therefore the rate of flow of these gases is increased and improves the effectiveness of the cooling.

It has been found that the tunnel described hereinbefore permits a continuous and rapid cooling at a precise temperature within a wide range of very diverse products among which may be mentioned products of rubber or plastics material, articles of confectionery, biscuit, pastry, cheese and delicatessen manufacture, etc.

As a modification, a cryogenic liquid other than $CO_2$ may be used, for example liquid nitrogen, for supplying cold to the tunnel.

What is claimed is:

1. A process for cooling a product by injection of a cryogenic liquid into an elongated tunnel through which said product travels longitudinally, comprising dividing the tunnel into a first longitudinally-extending compartment and a second longitudinally-extending compartment which communicate with each other at opposite ends of the tunnel and at opposite ends of the compartments, and that communicate with each other at a place which is intermediate the length of the tunnel and intermediate the length of the compartments, conveying the product longitudinally through the first compartment, injecting the cryogenic liquid into the second compartment, and creating between the two compartments a forced circulation of gases resulting from a vaporization of the liquid by blowing said gases from the second compartment into the first compartment at said intermediate place.

2. A process according to claim 1, wherein the two compartments are in superimposed relation to each other.

3. A process according to claim 1, wherein said intermediate place is located substantially midway of said length.

4. A process according to claim 1, comprising injecting the cryogenic liquid from adjacent only one end of the tunnel.

5. A process according to claim 1, comprising regulating the injection of the cryogenic liquid by measuring the temperature of said gases at a point of the tunnel where said liquid is completely vaporized.

6. A product-cooling elongated tunnel, comprising a partition dividing the tunnel into a first longitudinally-extending compartment and a second longitudinally-extending compartment which communicate with each other at opposite ends of the tunnel and at opposite ends of the compartments, and that communicate with each other at a place which is intermediate the length of the tunnel and intermediate the length of the compartments, means for conveying the product longitudinally through the first compartment, means for injecting a cryogenic liquid into the second compartment, and circulation means for passing gases resulting from vaporization of the liquid from the second compartment to the first compartment at said intermediate place.

7. A tunnel according to claim 6, the partition being horizontal.

8. A tunnel according to claim 6, wherein the partition has a notable thickness in order to reduce the section of passage for the gases.

9. A tunnel according to claim 6, wherein said circulation means comprise an opening in the partition at said intermediate place, and a fan mounted in said opening.

10. A tunnel according to claim 9, wherein said fan is an axial-flow fan.

11. A tunnel according to claim 6, wherein said intermediate place is substantially midway of the length of the tunnel.

12. A tunnel according to claim 6, comprising a longitudinally-extending deflector mounted in confronting relation to an outlet of the fan.

13. A tunnel according to claim 6, wherein said injection means open adjacent a single end of the tunnel.

14. A tunnel according to claim 6, comprising a temperature probe for measuring the temperature of the gases at a point of the tunnel where the cryogenic liquid is completely vaporized, and a electrically-operated valve for regulating the infection of said liquid connected to the probe for being controlled thereby.

* * * * *